United States Patent [19]

Kontz

[11] 4,402,467

[45] Sep. 6, 1983

[54] WEB HANDLING APPARATUS

[75] Inventor: Robert F. Kontz, Toledo, Ohio

[73] Assignee: Owens-Illinois, Inc., Toledo, Ohio

[21] Appl. No.: 271,732

[22] Filed: Jun. 8, 1981

[51] Int. Cl.[3] ..... B65H 19/10; B65H 19/22; B65H 19/24

[52] U.S. Cl. ..... 242/58.2; 242/58; 242/58.3; 242/58.6

[58] Field of Search ..... 242/58.1, 58.2, 58.3, 242/58.4, 58.5, 99, 156.1, 129, 58, 58.6; 226/189; 156/502, 504

[56] References Cited

U.S. PATENT DOCUMENTS

| | | | |
|---|---|---|---|
| 2,000,809 | 5/1935 | Wood | 242/58.2 |
| 2,454,093 | 11/1948 | Roesen | 242/58.2 |
| 2,490,685 | 12/1949 | Greene | 242/58.6 |
| 3,071,333 | 1/1963 | Looser | 242/58.2 X |
| 3,172,613 | 3/1965 | Simons | 242/58.2 |
| 3,637,155 | 1/1972 | Pato | 242/58.1 |
| 3,645,463 | 2/1972 | Heim | 242/58.1 |

FOREIGN PATENT DOCUMENTS

| | | | |
|---|---|---|---|
| 2826715 | 12/1979 | Fed. Rep. of Germany | 242/58.1 |
| 56-33339 | 4/1981 | Japan | 242/58.2 |

*Primary Examiner*—Stuart S. Levy
*Assistant Examiner*—Lloyd D. Doigan
*Attorney, Agent, or Firm*—J. R. Nelson; M. E. Click

[57] ABSTRACT

A web handling apparatus for selectively positioning web rolls so that the web from each roll can be moved past a work station such as a splicing station comprising a frame and a suspension arm pivoted to the frame for swinging movement about a horizontal axis. The arm is movable between first and second positions on each side of a vertical plane containing the horizontal axis. A pair of roll supports are positioned on the arm such that when the arm is in the first position, one roll is supported so that the web thereof is aligned longitudinally with a work station, and when the arm is in the second position, the other roll is supported with the web longitudinally aligned with the work station whereby the web can be removed and moved horizontally past the work station.

8 Claims, 5 Drawing Figures

WEB HANDLING APPARATUS

This invention relates to web handling apparatus and particularly to apparatus for handling webs which are being fed to a splicing station.

BACKGROUND AND SUMMARY OF THE INVENTION

In the use of webs from supply rolls which are fed to production machines for making or forming the webs into articles, such as articles of expanded plastic, it is necessary to splice the trailing end of the web being supplied from a roll to the leading end of a web which is to be used from another roll without interrupting production of the machine. In the splicing, it is also preferred to have the leading end of the web from the new supply roll overlie and be brought into contact with the trailing end of the web from the roll which is supplying the web.

Accordingly, among the objects of the present invention are to provide a web handling apparatus that will permit the leading end of the web from the new supply roll to be fed to the same side of the web being supplied for splicing at a splicing station; which will handle relatively wide webs; which apparatus is simple and reliable and produces no interruption in the web being fed to the production machines.

The web handling apparatus embodying the invention comprises a frame and a suspension arm pivoted to the frame for swinging movement about a horizontal axis. The arm is movable between first and second positions on each side of a vertical plane containing the horizontal axis. A pair of roll supports are provided on the arm and are positioned such that when the arm is in the first position, one roll is supported so that the web thereof is aligned longitudinally with a work station, and when the arm is in the second position, the other roll is supported with the web longitudinally aligned with the work station whereby the web can be removed and moved horizontally past the work station.

DESCRIPTION

The invention relates to web handling apparatus for use in holding rolls of web material which are fed to a machine for making articles such as expanded plastic articles. As one roll is used, it is necessary to bring another roll into position and minimize any delay in feeding in order that the production of the machine will not be adversely affected.

Figure 1:
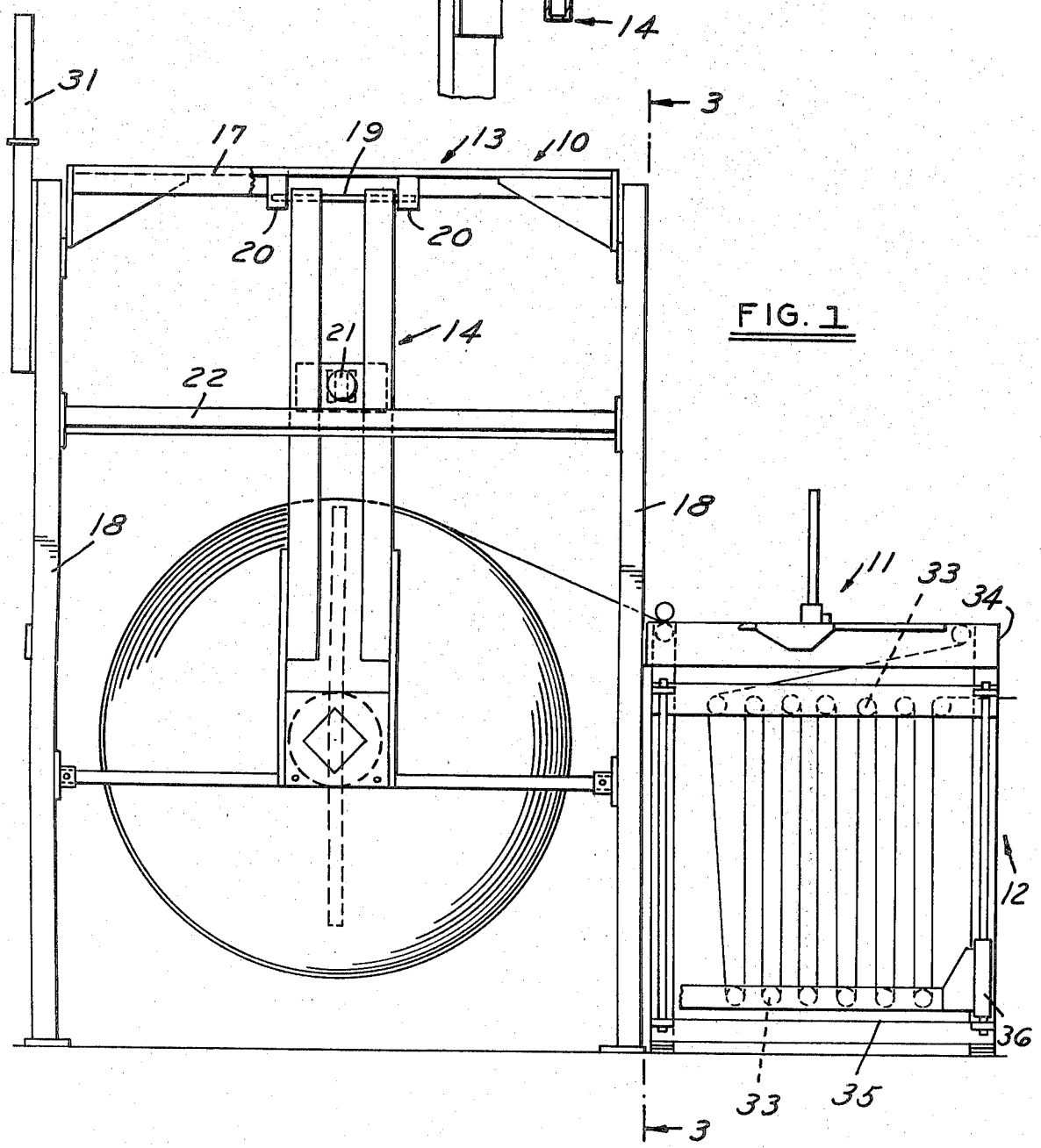
FIG. 1 is a side elevational view of a web handling apparatus embodying the invention.

As shown in FIG. 1, the web handling apparatus comprises a stand 10 from which the web is fed through a work station 11, such as a splicing station, and then to an accumulating apparatus 12 from which the web is fed to the machine.

Figure 3:
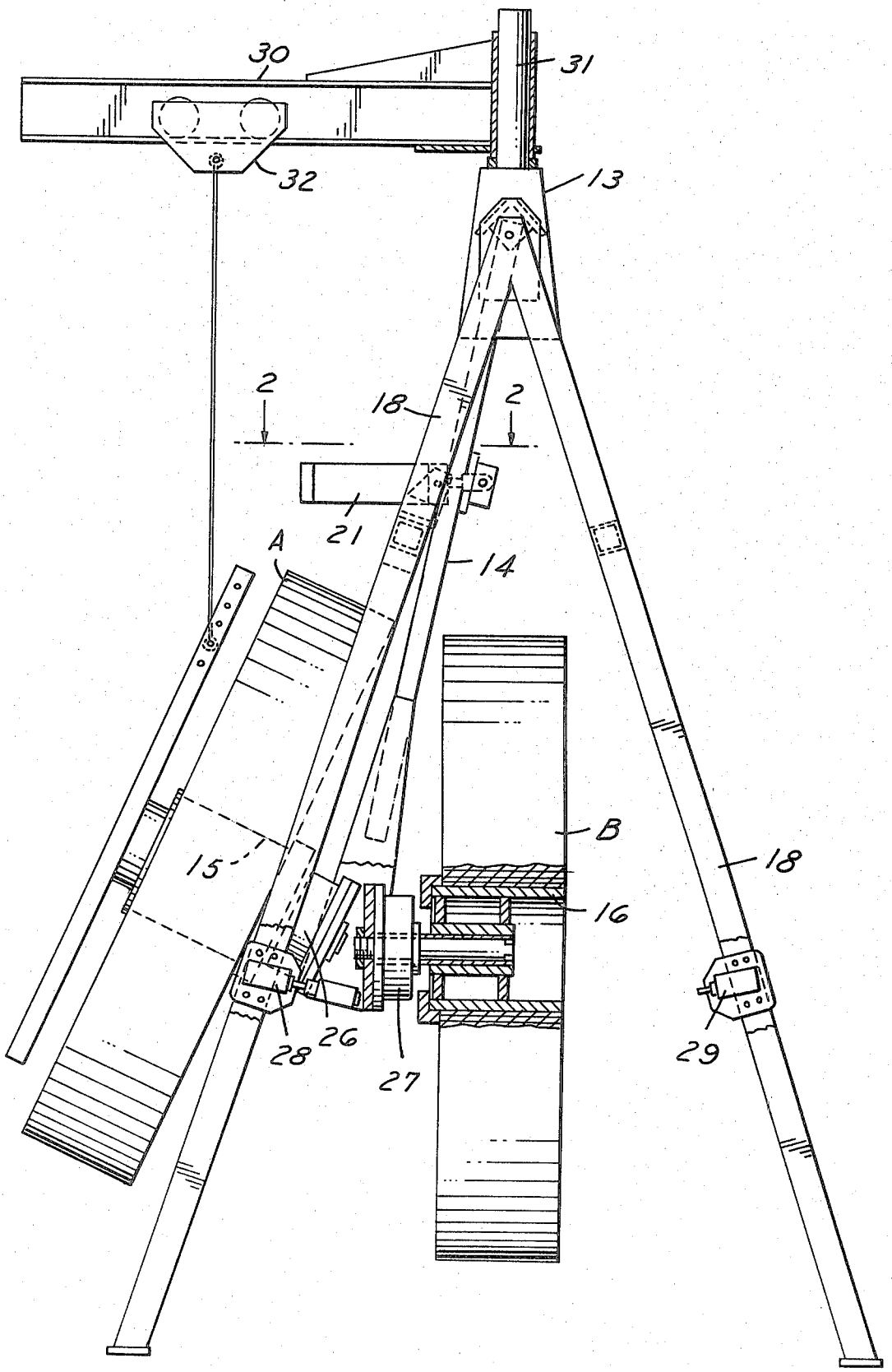
FIG. 3 is a part sectional view taken along the line 3—3 in FIG. 1, parts being broken away.
Figure 4:
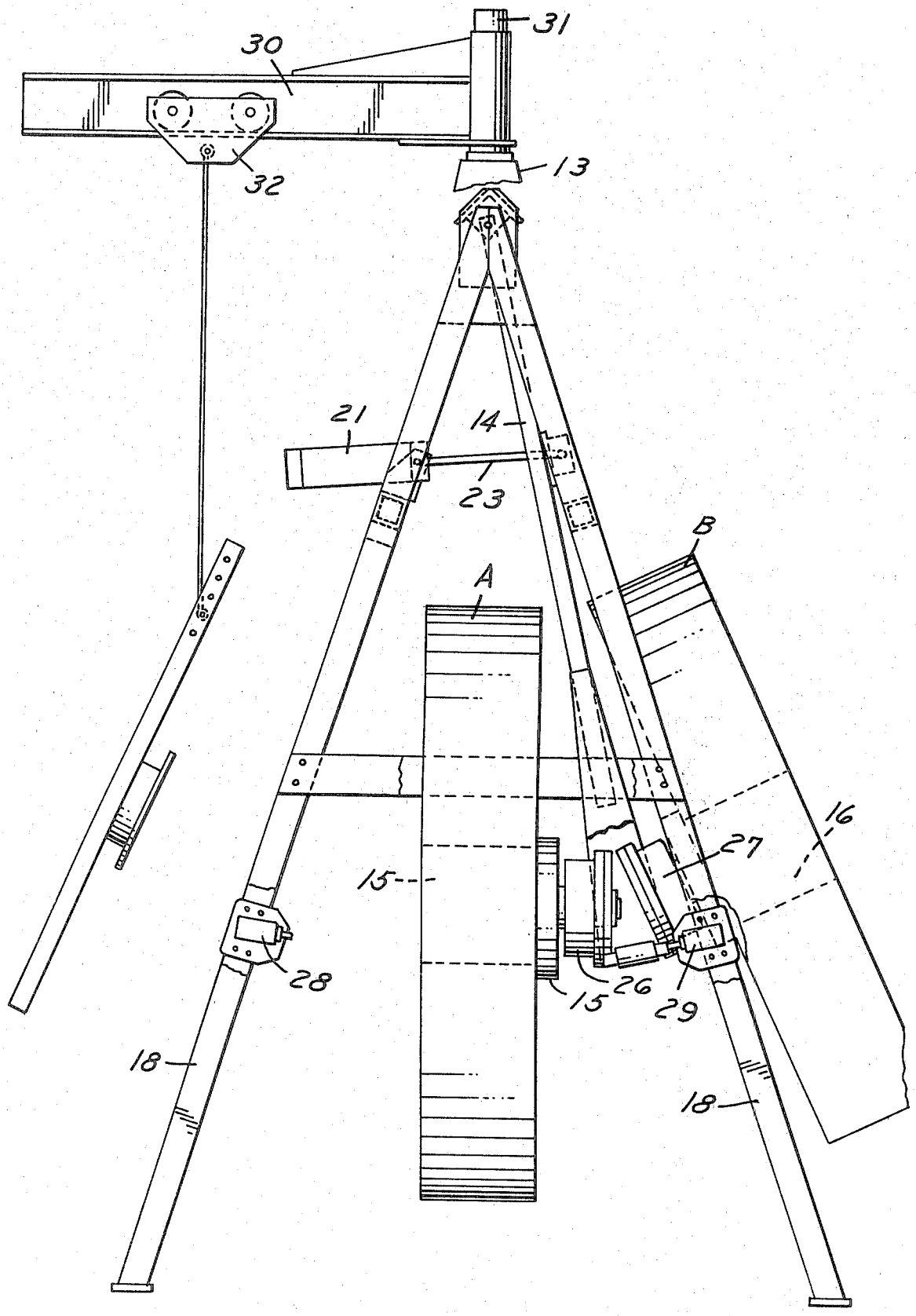
FIG. 4 is a view similar to FIG. 3 showing the parts in a different operative position.

As shown in FIGS. 1, 3 and 4, the stand 10 comprises a frame 13 on which a suspension arm 14 is pivoted for swinging movement about a horizontal axis. Web roll hubs or supports 15, 16 are provided on the lower end of the support arm 14 for supporting web rolls A, B.

The frame 13 comprises a horizontal bridge 17 and legs 18 at each end thereof which extend downwardly to the floor. The support or swing arm 14 comprises spaced bars which are pivoted on a horizontal shaft or pin 19 extending between support brackets 20 on the bridge member 17.

Each hub is rotatably mounted on suspension arm 14 such that when arm 14 is in a first position adjacent one set of legs 18, as shown in FIG. 3, the hub 16 has its axis extending horizontally and is positioned centrally of the stand 10 and when the arm 14 is in a second position adjacent the other set of legs, as shown in FIG. 4, the hub 15 has its axis extending horizontally and is positioned centrally of the stand 10.

Figure 2:
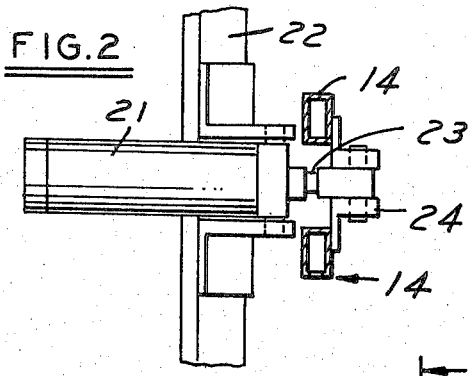
FIG. 2 is a fragmentary sectional view taken along the line 2—2 in FIG. 3.

A pneumatic cylinder 21 is pivotally mounted on a horizontal support bar 22 extending between legs 18 at opposite ends of the frame and has its shaft 23 pivotally connected to a bracket 24 (FIG. 2) extending between the arms of the support arm 14 so that actuation of the cylinder 21 will swing the arm 14 between a first position as shown in FIG. 3, supporting the roll B about a horizontal axis, and a second position as shown in FIG. 4, supporting the roll A about a horizontal axis.

When the rolls A or B are in position wherein their axes are horizontal, the web removed therefrom will pass horizontally through the work station 11.

Each hub or support 15, 16 has a brake 26, 27 associated therewith which may be pneumatically operated and provide a drag opposing the rotation of the roll and thereby controlling the feed from the roll. Shock absorbers 28, 29 are provided on opposed legs 18 and functions to absorb the shock of movement of the arm 14 between the two positions.

In order to facilitate handling of the rolls for loading onto the roll supports 15, 16 a crane is provided on the frame and includes a horizontal beam 30 mounted for swinging movement on a vertical shaft 31 on one end of the bridge member 17 and supporting a trolley 32 movable along the beam.

As shown in FIG. 1, the festooning apparatus 12 comprises a plurality of rollers 3 mounted on a frame 34 and rollers 33 mounted on a bar 35 movable vertically on the frame 34. The web to be accumulated is fed over the rollers and then to the production machine. During the splicing or other operation at station 11, when the web being fed across the splicing station is interrupted, a cylinder 36 progressively moves the bar 35 vertically, permitting the accumulated web to continue to supply web to the production machine so that the operation of the machine is not interrupted. Upon completion of the splice, the cylinder 36 is actuated to return the bar 35 to its original solid line position as viewed in FIG. 1 so that a new supply of web can be accumulated for use in a subsequent splicing operation.

Figure 5:
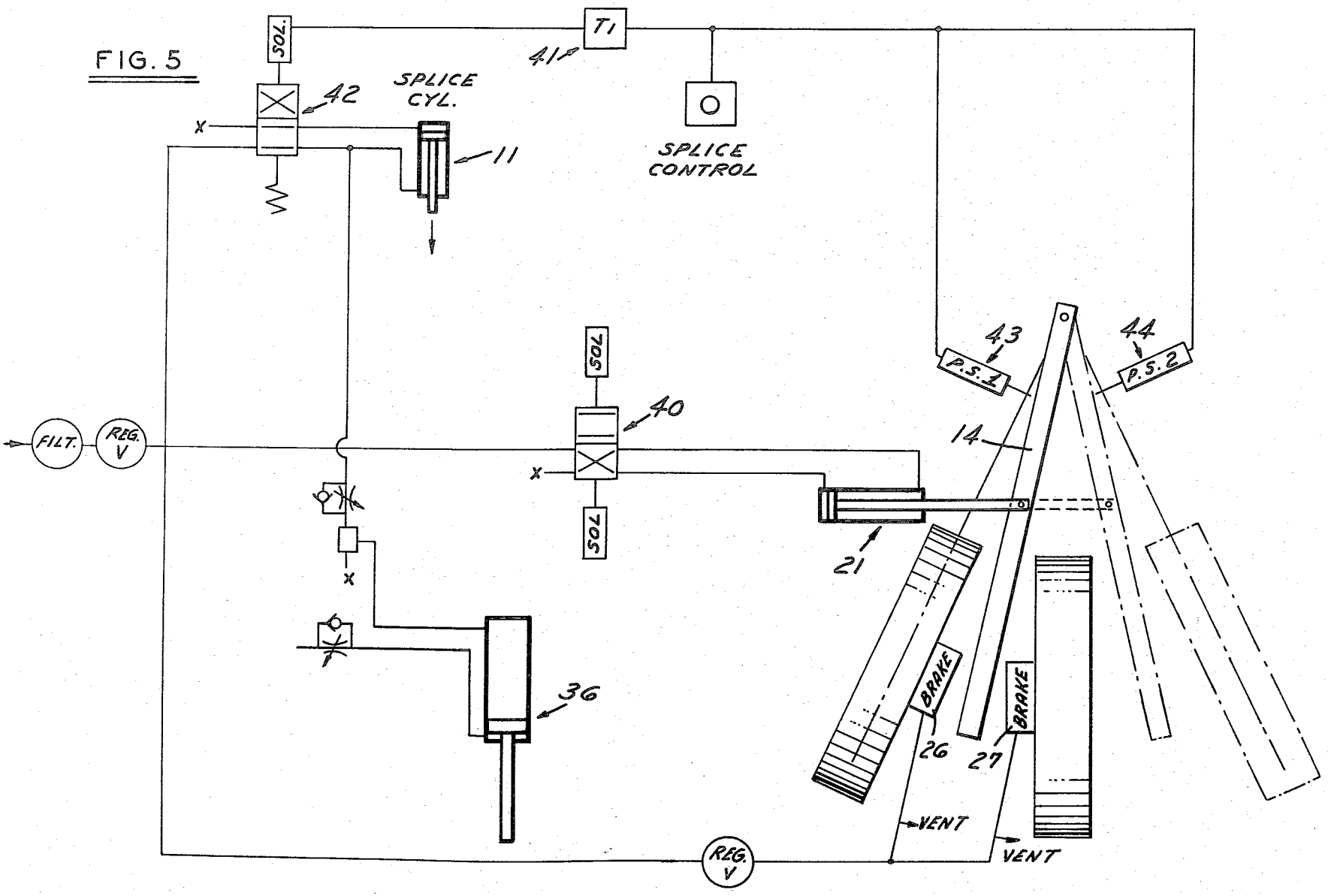
FIG. 5 is a schematic diagram of the pneumatic circuit.

FIG. 5 is a schematic diagram of the pneumatic circuit,for the system. As shown, air is normally supplied to the cylinder 21 for swinging the support arm 14 through a double acting solenoid valve 40. As the web from one roll is reaching its end and there is a need for splicing the trailing end of the web from the one roll with the leading end of another roll, the cycle is manually initiated which energizes the timer 41 actuating a solenoid actuated valve 42 that operates the splicing apparatus 11 shown diagrammatically as a cylinder. At the same time, the cylinder 36 is actuated to permit feeding of the accumulated web from the festooning apparatus 12. Also simultaneously double acting solenoid valve 40 is operated to swing the roll having the new web to a position where its axis is horizontal. The circuit also functions as shown to provide operation of the brakes. In the electrical control circuit, position switches 43, 44 sense the position of the arm so that the cylinder can be moved in the correct direction for moving the new roll into position.

In operation, assuming the web is being unwound from roll A by the production machine, when it is almost all used up, the splicing apparatus 11 will be actuated, temporarily stopping the web and splicing the lead end of roll B to the tail end of roll A.

While the web is stopped in the splicer, the positioning cylinder 21 extends, moving roll A out of its position simultaneously moving roll B into alignment with the splicing apparatus 11 and the festooning apparatus 12. When the splicing is completed, the material is then being supplied by roll B.

While roll B is being used up, the operator can reload roll A with a new roll of web material preparatory to splicing when roll B is used up.

I claim:

1. A web handling apparatus for selectively positioning a pair of web rolls so that the web from each roll can be moved past a work station, such as a splicing station, comprising a frame, a suspension arm having a first end pivoted to and depending from said frame for swinging movement about a horizontal axis, said arm being movable between first and second positions on each side of a vertical plane containing the horizontal axis, positioning means for moving the suspension arm between said first and second positions comprising a cylinder including a cylinder housing mounted on said frame and a shaft connected to said suspension arm, a pair of roll supports attaching on a second end of said suspension arm positioned such that when the arm is in said first position, one roll of said pair of web rolls is supported so that the web thereof is aligned longitudinally with a work station, and when the arm is in said second position, the other roll of said pair of web rolls is supported with the web thereof longitudinally aligned with the work station, whereby the web can be removed from a said longitudinally aligned roll and moved past the work station.

2. The web handling apparatus set forth in claim 1 including shock absorber means associated with the first and second positions of said arm for absorbing and decelerating the movement of the arm to the respective positions.

3. The web handling apparatus set forth in claim 1 including brake means associated with each said roll support for providing a drag on the web roll supported by the roll support.

4. A web handling apparatus for selectively positioning a pair of web rolls so that the web from each roll of said pair of rolls can be moved past a work station, such as a splicing station, comprising a frame comprising a horizontal bridge member and legs supporting said bridge member, a suspension arm having a first end pivoted to and depending from said bridge member for swinging movement about a horizontal axis, said arm being movable between first and second positions on each side of a vertical plane containing the horizontal axis, a pair of roll supports attaching on a second end of said arm positioned such that when the arm is in said first position, one roll support of said pair of rolls is supported so that its said roll has its axis extending horizontally and the web thereof is longitudinally aligned with a work station, and when the arm is in said second position, the other roll of said pair of rolls is supported so that its said roll has its axis extending horizontally and the web thereof is longitudinally aligned with the work station, whereby a longitudinally aligned web can be removed and moved past the work station.

5. A web handling apparatus for selectively positioning a pair of web rolls so that the web from each roll of the pair of said rolls can be moved past a work station, such as a splicing station, comprising a frame comprising a horizontal bridge member and legs supporting said bridge member, a suspension arm having a first end pivoted to and depending from said bridge member for swinging movement about a horizontal axis, said arm being movable between first and second positions on each side of a vertical plane containing the horizontal axis, positioning means for moving the suspension arm between said first and second positions, a pair of roll supports attaching on a second end of said arm positioned such that when the arm is in said first position, one roll support is supported so that its roll of said pair of rolls has its axis extending horizontally and the web thereof is longitudinally aligned with a work station, and when the arm is in said second position, the other roll support is supported so that its roll of said pair of rolls has its axis extending horizontally and a longitudinally aligned web thereof is longitudinally aligned with the work station, whereby the web can be removed and moved past the work station.

6. The web handling apparatus set forth in claim 5 wherein said positioning means comprises a cylinder including a cylinder housing pivotally mounted on said frame and a shaft pivotally connected to said suspension arm.

7. The web handling apparatus set forth in claim 6 including shock absorber means on said frame and associated with the first and second positions of said arm for absorbing and decelerating the movement of the arm to the respective positions.

8. The web handling apparatus set forth in claim 7 including brake means associated with each said roll support for providing a drag on the web roll supported by the roll support.

* * * * *